US012134448B2

(12) United States Patent
Hornbaker et al.

(10) Patent No.: US 12,134,448 B2
(45) Date of Patent: Nov. 5, 2024

(54) INFLATABLE WATER SAFETY HARNESS WITH LOAD BEARING STRUCTURE

(71) Applicant: Greater Oceans Inc., Dana Point, CA (US)

(72) Inventors: Jeffery Hornbaker, Dana Point, CA (US); Eric Thorstenson, San Diego, CA (US)

(73) Assignee: Greater Oceans Inc., Dana Point, CA (US)

( * ) Notice: Subject to any disclaimer, the term of this patent is extended or adjusted under 35 U.S.C. 154(b) by 121 days.

(21) Appl. No.: 17/493,034

(22) Filed: Oct. 4, 2021

(65) Prior Publication Data

US 2022/0111941 A1 Apr. 14, 2022

Related U.S. Application Data

(60) Provisional application No. 63/148,404, filed on Feb. 11, 2021, provisional application No. 63/091,896, filed on Oct. 14, 2020.

(51) Int. Cl.
*B63C 9/125* (2006.01)
*A41D 13/012* (2006.01)

(52) U.S. Cl.
CPC ..... *B63C 9/1255* (2013.01); *A41D 13/0125* (2013.01)

(58) Field of Classification Search
CPC ..... B63C 9/1255; A41D 13/0125; A41D 13/0007; A41D 13/012; A62B 35/0018
See application file for complete search history.

(56) References Cited

U.S. PATENT DOCUMENTS

| | | | | |
|---|---|---|---|---|
| 2,361,414 | A * | 10/1944 | Ramsey | B63C 9/20 362/108 |
| 6,367,582 | B1 | 4/2002 | Derby | |
| 7,922,422 | B2 | 4/2011 | Sullivan | |
| 8,322,488 | B2 | 12/2012 | Green | |
| 8,911,273 | B2 | 12/2014 | Chouinard et al. | |
| 8,931,593 | B2 | 1/2015 | Harris | |
| 9,067,658 | B2 | 6/2015 | Hughes | |
| 2014/0213128 | A1* | 7/2014 | Hughes | B63C 9/1255 441/92 |

(Continued)

FOREIGN PATENT DOCUMENTS

| | | |
|---|---|---|
| EP | 3766548 A1 | 1/2021 |
| GB | 1233761 A | 5/1971 |

OTHER PUBLICATIONS

Reporter's Transcript of Proceedings in the United States District Court Central District of California Western Division, *Greater Oceans, Inc.*, vs *Eric Thorstenson, et al.*, dated Jul. 11, 2023, Los Angeles California (161 pages).

*Primary Examiner* — Andrew Polay
(74) *Attorney, Agent, or Firm* — Patterson Intellectual Property Law, PC; Seth R. Ogden; Nathan I. North

(57) ABSTRACT

The present disclosure relates, in one aspect of the disclosure, to an inflatable water sport safety garment for providing buoyancy to a wearer comprising a harness structure, at least one handle, and at least one inflatable flotation device. The harness structure may include at least two shoulder portions, at least one torso portion encircling the torso of the wearer and attached to the shoulder portions, and at least one central portion connected to the shoulder portions.

19 Claims, 9 Drawing Sheets

(56) References Cited

U.S. PATENT DOCUMENTS

| | | | | |
|---|---|---|---|---|
| 2014/0322998 | A1* | 10/2014 | Mead | B63C 9/11<br>441/84 |
| 2019/0150530 | A1 | 5/2019 | Basta et al. | |
| 2021/0129956 | A1* | 5/2021 | Cohen | A41F 9/005 |

* cited by examiner

INFLATABLE WATER SAFETY HARNESS WITH LOAD BEARING STRUCTURE

This application claims the benefit of U.S. Provisional Application Ser. Nos. U.S. Provisional No. 63/091,896 filed Oct. 14, 2020, and U.S. Provisional No. 63/148,404 filed Feb. 11, 2021, the contents of which are incorporated herein in their entirety by reference.

1. FIELD OF THE DISCLOSURE

The present invention generally relates to the field of safety devices, and more particularly relates to inflatable safety garments, vests, and harnesses to be used by swimmers and other water sport participants, wherein the safety garment specifically incorporates an internal load bearing harness structure designed to allow for reliable and safe support of the wearer when the harness is used to engage with the wearer and/or lift or extract the wearer of the safety garment from the water. In certain embodiments, the safety garment and harness includes at least one inflatable flotation device which may be inflated by the wearer, either manually or by triggering one or more compressed air or carbon dioxide canisters. The safety garment and harness may have in certain embodiments a garment portion to which the harness structure is attached or integrally formed.

Additional elements and features of different embodiments of the safety garment and harness include a release valve within each inflatable flotation device to allow for quick release of air within each inflatable flotation device; a plurality of attachment loops to allow for quickly attaching and detaching various tools and elements to the harness for easy access by the wearer during usage, with such tools and elements including, without limitation, rebreathers, SCUBA cylinders, SUBA cylinders, tools, tool belts, reflectors, acoustic sirens, and/or GPS locators.

2. BACKGROUND

All water sports, whether simple boating or jet skiing, to the more involved SCUBA diving, triathlons, and big wave surfing, all have an element of risk and danger associated with such activities. More particularly, all such participants in water sports need to be aware of safety concerns and should use a life vest or safety harness of some type during such water sports activities.

There is no shortage of various types of life preservers and life vests available and used by water sport enthusiasts. But these life vests are usually simple and not fully effective for more involved, or more technical water sports such as SCUBA diving or big wave surfing. Moreover, such "old-school" life preservers are often much too cumbersome and bulky for other water sport activities such as triathlons. For these more involved activities, there is a need for the safety harness to have variable and/or increased flotation mechanisms such as air bladders or aircells that can be filled by the wearer when the need arises for additional buoyancy. Further, in water activities in which an athlete is wearing a safety harness/vest, there is a need for the safety harness/vest to be load bearing at least in excess of the wearer's weight so that when needed, the athlete may be lifted out of the water using the safety harness. Such load bearing capabilities are not adequately addressed in the prior art.

While there are many different styles and types of life preservers and safety vests, there are still issues with and improvements that can be made to such products to address the various needs of water sports participants. One such issue relating to usage and efficacy of safety vests is the need and ability for a third party, such as a rescuer or life guard, to readily grab the safety vest, and then lift and extract the wearer of the vest out of the water. Current designs for safety vests do not have any ready means for a third party to grab and attach to the vest, nor are current designs capable of lifting the wearer by the vest using grab points on the vest. This severely limits the utility of these safety vests and life preservers.

While others have designed variations of life preservers and safety vests, some of which may appear to address some of the issues and problems known in the field and technology, none of these designs fully address or resolve these noted problems.

More particularly, U.S. Pat. No. 7,922,422 for a Low Profile Buoyancy Adjustment Controller and Valve System for Diver's Vest, assigned to AquaLung America, teaches a buoyancy adjustment device that uses an inflation valve connected between the diver's breathing gas supply and a compartment to admit gas into the compartment to increase the diver's buoyancy. The '422 patent does not disclose or teach a design for a buoyancy vest with an internal load bearing harness or having multiple grab or engagement elements incorporated into the diver's vest.

Further, U.S. Pat. No. 8,911,273 for a Watersports Inflation Vest, assigned to Patagonia, Inc., teaches a selectively inflatable watersports inflation device that is a vest or another wearable device having an inner layer, an outer layer, and a bladder between the inner and outer layer. The '273 patent further describes including one or more canisters coupled to the bladder and configured to selectively deliver pressurized gas into the bladder to provide flotation. However, the '273 patent does not teach or disclose a buoyancy vest having an internal load bearing harness or having multiple grab or engagement elements incorporated into the inflation vest.

Similarly, U.S. Pat. No. 9,067,658 for an Inflatable Swim Vest, by Hughes, teaches an inflatable swim vest constructed with a first layer and second layer having respective outer edges variously secured together by fixtures to define a compartment therebetween. As is the case with the above '273 patent, the '658 application provides no disclosure for the swim vest to incorporate any internal load bearing harness or having multiple grab or engagement elements that are incorporated as part of the swim vest.

As noted, while there are various prior designs and prior art relating to inflation vests, none appear to provide solutions and complete consideration of the noted problems and issues, including the need for a load bearing harness incorporated within a vest to allow for extraction of the wearer by lifting of the vest. These issues, as well as other features and advantages taught by the inventive water safety harness are disclosed and explained in the following specification.

BRIEF SUMMARY

Briefly, the present disclosure relates, in one aspect of the disclosure, to an inflatable water sport safety garment for providing buoyancy to a wearer comprising a harness structure, at least one handle, and at least one inflatable flotation device. The harness structure may include at least two shoulder portions, at least one torso portion encircling the torso of the wearer and attached to the shoulder portions, and at least one central portion connected to the shoulder portions.

In another embodiment, the inflatable water safety harness may also comprise a garment portion that incorporates the harness structure and at least one inflatable flotation device. The garment portion, in another embodiment, may also include a zipper that allows the wearer to more easily put on and remove the inflatable water safety harness. The garment portion in another embodiment may also include at least one compartment configured to receive a flotation device.

In another embodiment, the inflatable water safety harness may further comprise at least one compressed gas canister such that each inflatable flotation device is connected to at least one compressed gas canister. When the gas canister is triggered, the gas canister is configured to substantially inflate each of the inflatable flotation devices the gas cannister is connected to. In another embodiment, the compressed gas canister contains $CO_2$.

In another embodiment, the inflatable flotation device further comprises an inlet valve that allows the wearer to manually inflate the inflatable flotation device. In other embodiments, the inflatable flotation device may include a relief valve that allows the wearer to deflate the inflatable flotation device.

In another embodiment, the harness structure may further comprise a crotch portion that is connected to the torso portion. The crotch portion includes two leg loops that receive each of the wearer's legs.

In another embodiment, the harness structure is capable of lifting a weight greater than approximately 300 pounds.

In another embodiment, the central portion of the harness structure may further comprise a back cross strap and a front cross strap. The back cross strap may connect the shoulder portions across the wearer's strap and the front strap may connect the shoulder portions across the wearer's chest. In another embodiment, the central portion of the harness structure may form a loop that connects to the at least two shoulder portions. The loop may also connect to the torso portion using a connecting portion.

In another embodiment, the inflatable water safety harness may further comprise at least one attachable device that connects to the torso portion. In some embodiments, the attachable device may be one of a radio, a GPS device, a set of first responder tools, a light emitting device, or a flotation device. In some embodiments, the attachable device may be detachably connectable to the torso portion.

In another embodiment, the inflatable flotation device may be configured to partially inflate to provide a chosen buoyancy support to the wearer.

In another embodiment, the handle may include a first end and a second end, each of which connects to a shoulder portion. In another embodiment, the handle may include a first end and a second end where the first end connects to one shoulder portion and the second end connects to one of the central portions. In another embodiment, the inflatable water safety harness comprises two handles.

In another aspect of the disclosure, an inflatable water safety harness for providing buoyancy to a wearer comprises a garment portion, a harness structure, and at least two inflatable flotation devices. The garment portion includes a full length zipper that allows the wearer to more easily put on and remove the inflatable water safety harness. The harness structure is configured to lift a weight greater than approximately 300 pounds and includes two shoulder portions, a torso portion, a central portion, a first handle, a second handle, and a third handle. The two shoulder portions each include two end sections. The torso portion encircles the waist of a wearer and slidably connects to the two end sections of each of the shoulder portions to a front and back section of the torso portion. The torso portion also includes a quick side release buckle. The central portion includes two end sections that are connected to the two shoulder portions to form an H-shaped harness structure. The first handle is connected to the first shoulder portion, the second handle is connected to the second shoulder portion, and the third handle is connected to the central portion. The at least two inflatable flotation devices are connected to the garment portion.

BRIEF DESCRIPTION OF THE DRAWINGS OF CERTAIN EMBODIMENTS

DETAILED DESCRIPTION OF CERTAIN EMBODIMENTS

The following provides a detailed description of certain exemplary embodiments of an inflatable water safety garment or vest, having an integral and internal load bearing harness structure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The inflatable water sport safety garment, as shown in FIGS. 1A-2B, incorporates and comprises a load bearing harness structure that may be configured in multiple ways for engaging and lifting a wearer of the safety garment out of the water solely through engagement and lifting of the safety garment being worn by the user. The safety garment integrally incorporates a harness structure capable of bearing a load comprising, as shown in FIGS. 3-7, in one embodiment, two shoulder straps, at least one torso strap that encircles the wearer's waist, at least one central portion, such as a cross strap, between the two shoulder straps, along with a plurality of handles integrally formed as part of the two shoulder straps and/or the cross straps. In one embodiment, as shown in FIGS. 8 and 9, the safety garment further comprises at least one inflatable flotation device that may be rapidly inflated using a compressed gas container or capsule. The safety garment provides enhanced capability for third parties to securely engage and rescue wearers of the safety garment through use of the harness structure.

Figure 3:
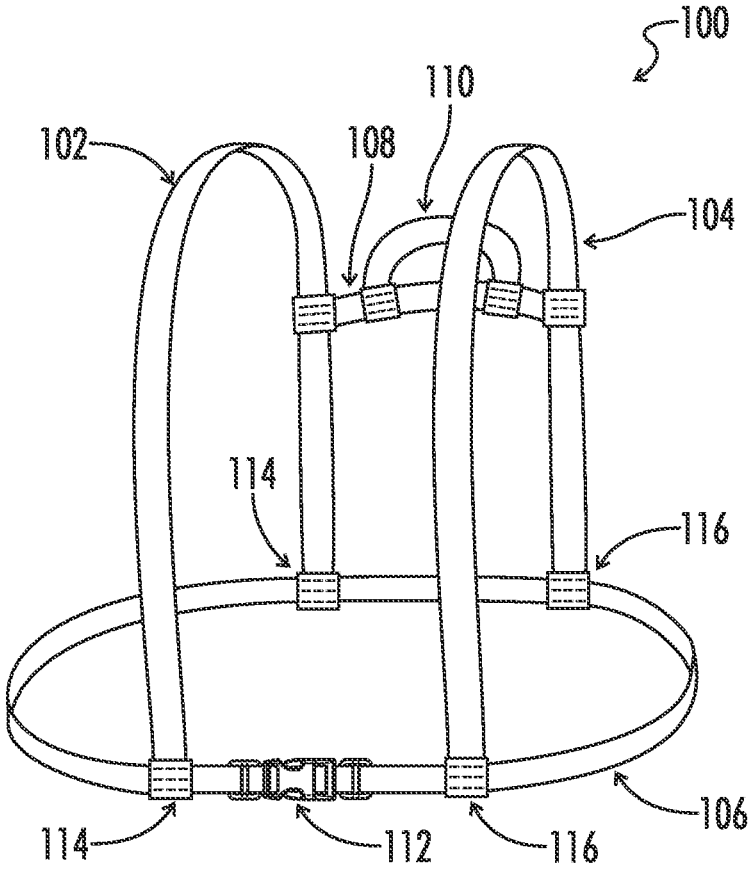
FIG. 3 is a front perspective view of an embodiment of the internal H-shaped harness structure.
Figure 4:
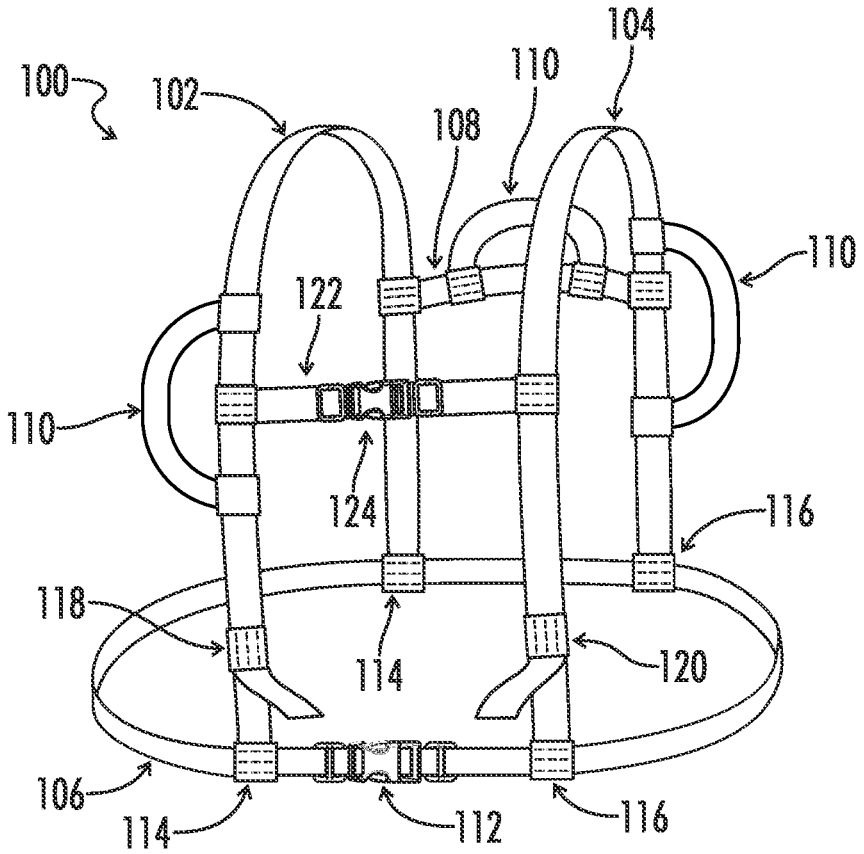
FIG. 4 is a front perspective view of an embodiment of the internal H-shaped harness structure.

More specifically, as detailed in FIGS. 3 and 4, the safety garment 10 comprises an integral load bearing harness 100, specifically shown in front, back, and isometric views. In further detail, as shown in FIGS. 3 and 4, the load bearing harness 100 comprises two shoulder straps 102, 104 forming two shoulder portions that are connected at both ends to at least one torso strap 106 forming a torso portion, at least one cross strap 108 forming a central portion, and further comprises at least one handle 110 such that each handle 110 is integrally attached to either or both of the shoulder straps 102, 104, the cross strap 108, and/or the torso strap 106.

Figure 5:
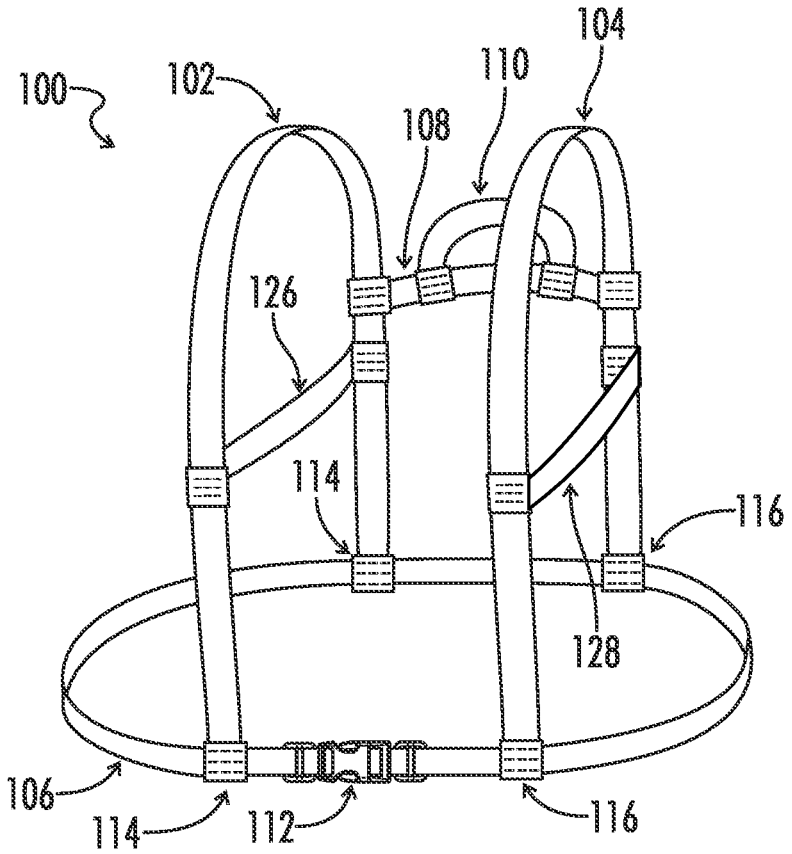
FIG. 5 is a front perspective view of a further embodiment of the internal H-shaped harness structure.

In one embodiment, as shown in FIGS. 3-5, the general shape of the load bearing harness 100 resembles an "H" configuration with the shoulder straps 102 and 104 forming the two sides of the "H" shape and the cross strap 108 located between the shoulder straps 102, 104 forming the center cross element of the "H" shape. The torso or waist strap 106 provides the end or attachment points for the "H" configuration of the load bearing harness 100. This shape and configuration more evenly distributes the load on the harness 100 and the wearer when the harness handles 110 are used to extract or lift the wearer out of the water.

As part of the torso strap 106, a releasable buckle element, such as a side release buckle 112 may be incorporated to allow for easy removing and donning of the safety garment 10.

In different embodiments, the end elements of the shoulder straps 102, 104 may be integrally formed with the torso strap 106, or alternatively may be configured to allow for some lateral movement of the end elements of each shoulder strap 102, 104 along the torso strap 106. By allowing some lateral movement of the shoulder strap end elements 114, 116 along the torso strap 106, the wearer is provided with some flexibility to adjust the shoulder straps 102, 104 position, and thereby increase the wearer's comfort. While some lateral movement of the shoulder strap ends 114, 116 is beneficial, separation of the shoulder strap 102, 104 end elements is effective for strength and load capacity optimization.

To allow for adjustment and comfort of the wearer, the torso strap 106 and both shoulder straps 102, 104 may also be configured to be adjustable in length. The shoulder straps 102, 104 adjustment elements 118, 120 may be located on the front segment of each shoulder strap 102, 104, as shown in FIG. 4, to allow the wearer to easily tighten or loosen the shoulder straps once the safety garment 10 is put on. Similarly, the release buckle 112 on torso strap 106 may be configured to allow the wearer to tighten or loosen the safety garment 10 around the wearer's waist. Such adjustment elements may be simple known buckles or other similar devices.

In other embodiments, the load bearing harness 100 may further include one or more additional central portions, such as cross strap 122 shown in FIG. 4. Where the cross strap 122 is provided on the front of the load bearing harness 100 and safety garment 10, or across the chest area of the wearer, it would be advantageous to incorporate a releasable buckle element, such as a side release buckle 124 to allow for easy removing and donning of the safety garment 10. One example of such side release buckles 112 and 124 are manufactured by Everbilt™. The central portion may also be a cross strap 108 across the back of the wearer. Further embodiments may include a cross strap across the front and the back, and other embodiments may further include multiple cross straps on the same side.

An additional embodiment of the safety garment 10 and load bearing harness 100 may include, as shown in FIG. 5, additional straps that would be positioned as underarm straps 126, 128 connecting the front and back of the shoulder straps 102, 104. The inclusion of the underarm straps 126, 128, provides additional safety and prevents the potential for the safety garment 10 from possibly riding up over the wearer where the safety garment 10 is lifted out of the water by a handle, such as handle 110. While the torso strap 106 is the primary structure preventing the safety garment 10 from being lifted over the head of the wearer, with underarm straps 126, 128, further protection and safety is provided, in particular in the case where the torso strap buckle 112 may have been released or is not latched.

Figure 6:
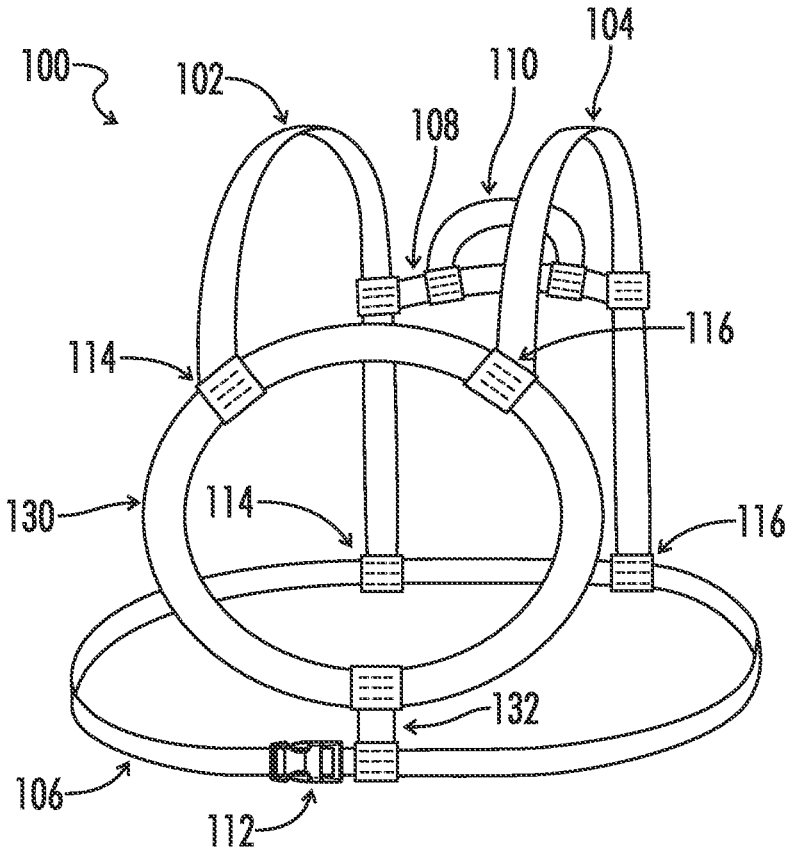
FIG. 6 is a front perspective view of a further embodiment of the internal Q-shaped harness structure.

In other embodiments, such as the embodiment shown in FIG. 6, the harness structure 100 may be configured in other shapes, such as a "Q" shape. In this embodiment, the central portion of the harness structure may form a loop 130 across the wearer's chest. The loop 130 may connect to the torso portion 106 using one or more connecting portions 132, such as a strap. The shoulder portions 102, 104 may connect to the top of the loop 130, pass over the shoulders, and extend down the wearer's back. An additional central portion in the shape of a loop may be on the back of the harness structure 100, or the shoulder portions 102, 104 may extend down the back of the harness structure 100 and connect to the torso portion 112.

Figure 7:
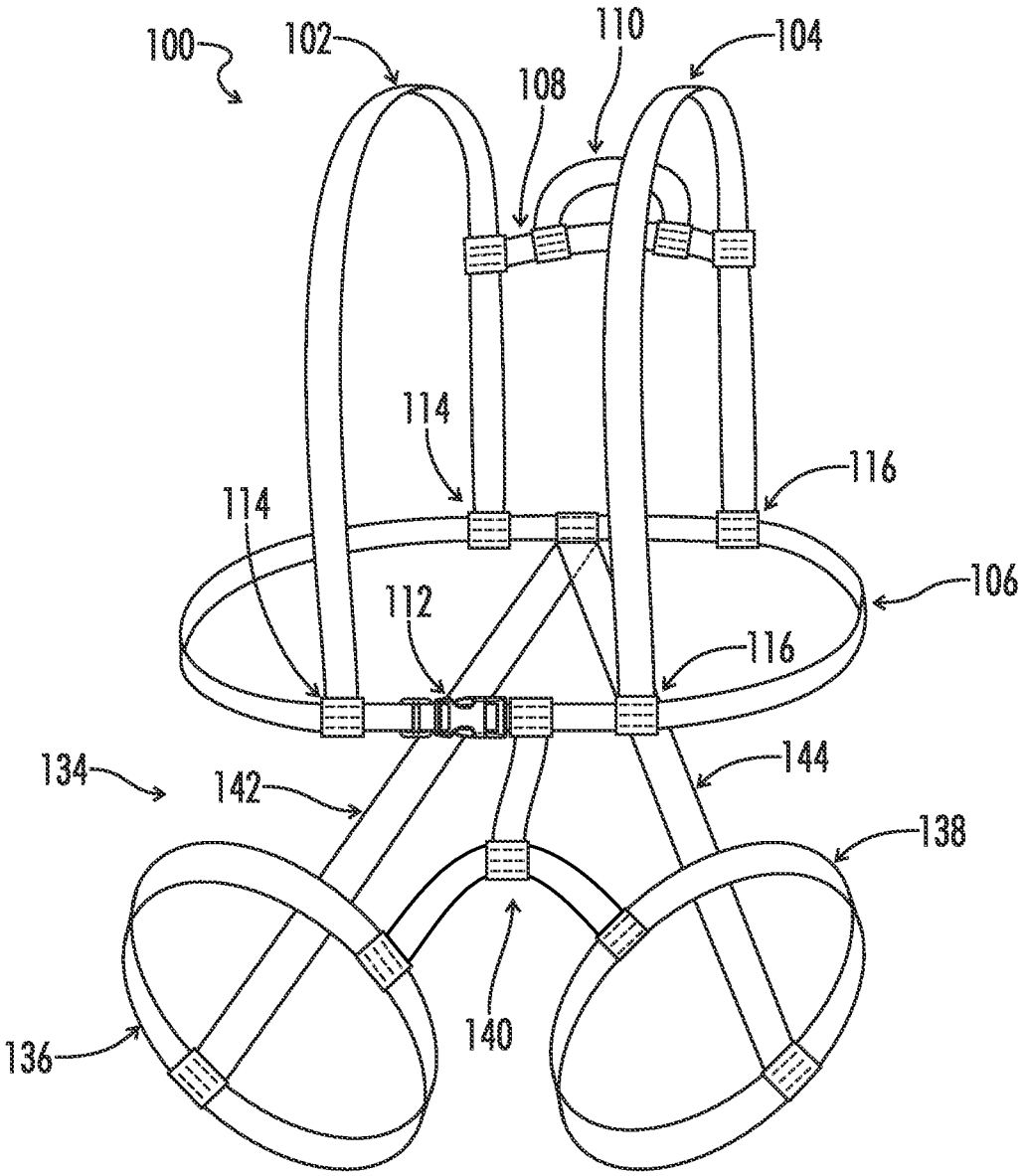
FIG. 7 is a front perspective view of a further embodiment of the internal harness structure further including a crotch portion.

The harness structure 100 in some embodiments, as shown in FIG. 7, may also include a crotch portion 134 to further distribute the load applied by lifting the wearer from the water. The crotch portion 134 may include two leg loops 136, 138 for receiving the wearer's legs. The crotch portion 134 may further be formed with the torso portion 106 or may connect to the torso portion 106 through connecting straps such as connecting straps 140, 142, 144.

The load bearing harness 100 may be made of, in part, a water resistant, and especially salt-water resistant material, such as polybutylene terephthalate ("PBT") or other similar thermoplastic or polymer material. Additional materials that may be used for the load bearing harness 100 include nylon, polyester, and other synthetic materials, woven with a ripstop pattern or configuration.

Figure 1A:
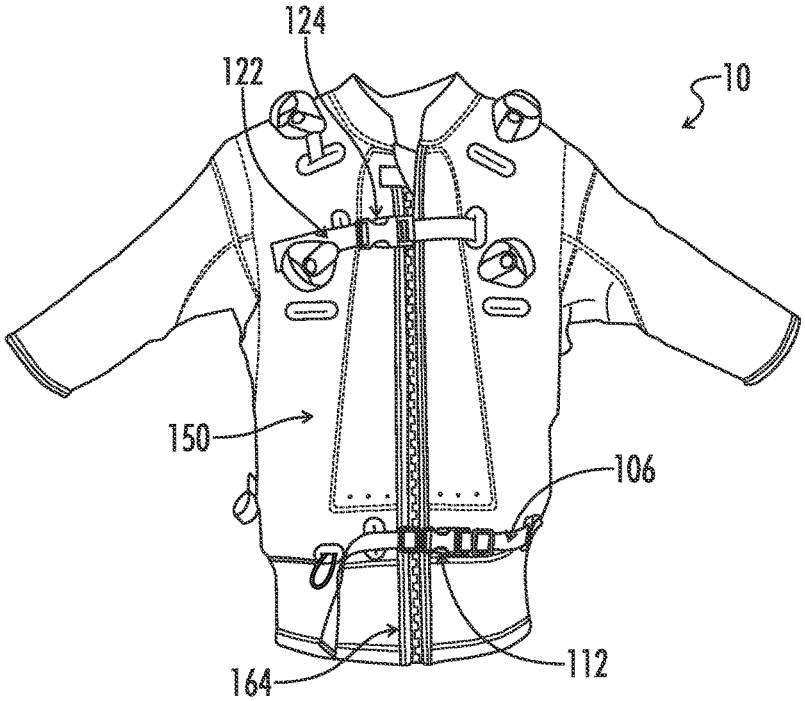
FIG. 1A is a front view of an embodiment of the inflatable safety harness/garment.
Figure 1B:
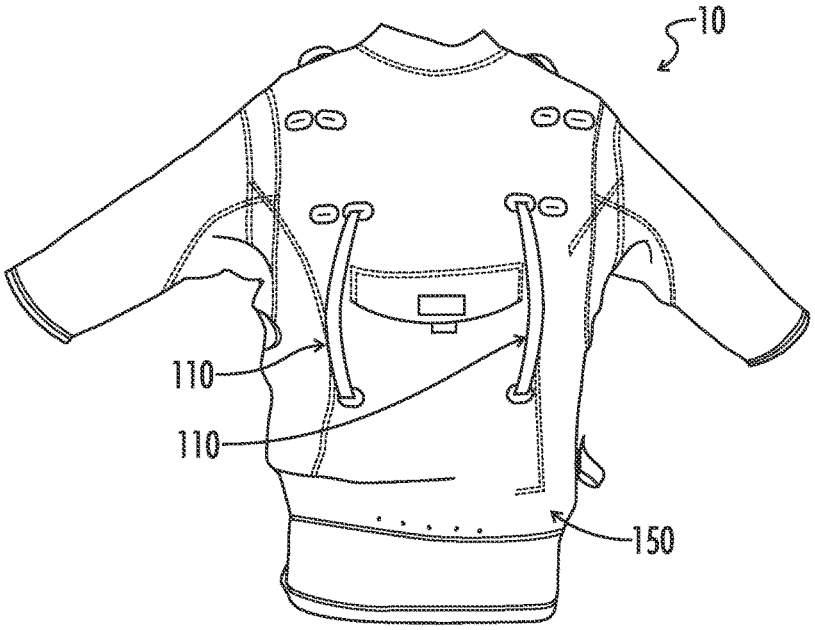
FIG. 1B is a back view of the inflatable safety harness/garment of FIG. 1A.
Figure 2A:
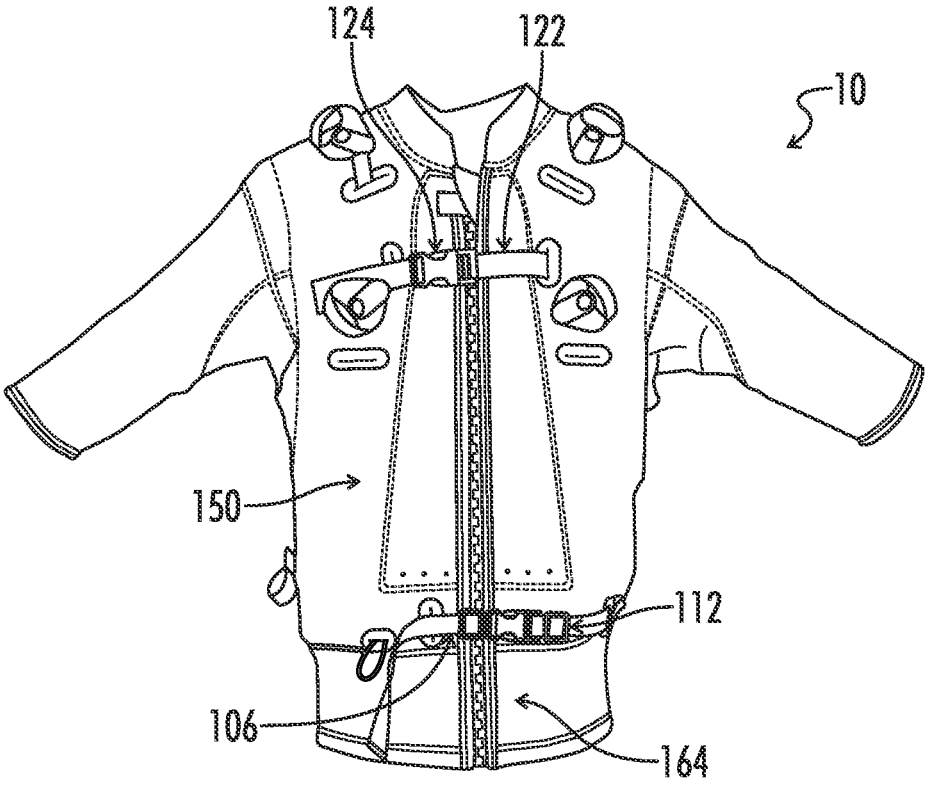
FIG. 2A is a front view of an embodiment of the inflatable safety harness/garment.
Figure 2B:
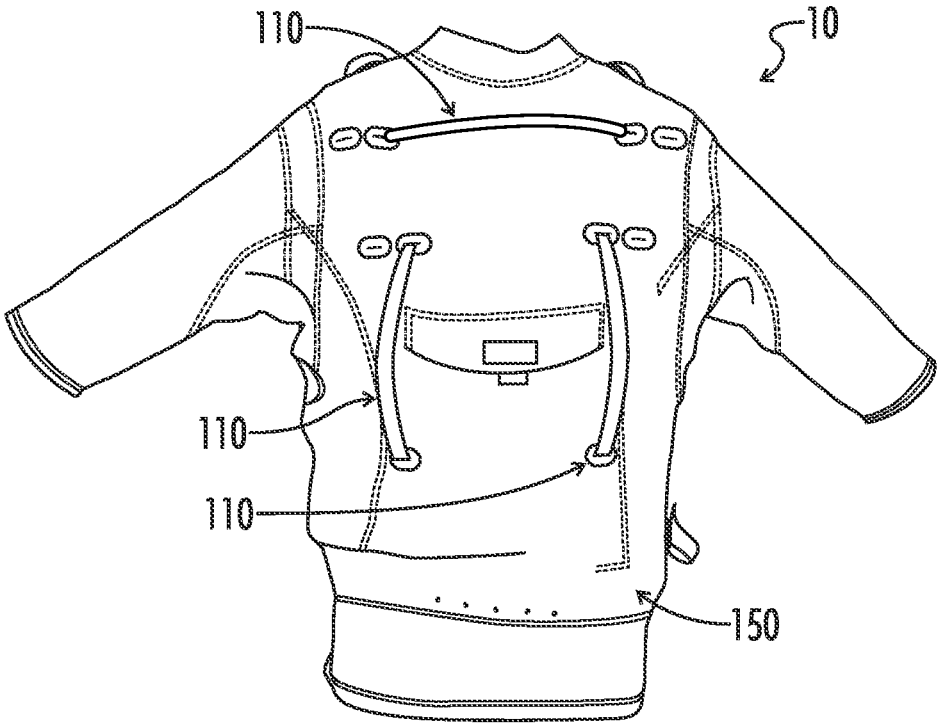
FIG. 2B is a back view of the inflatable safety harness/garment of FIG. 2A.

The safety garment 10, as shown in FIGS. 1B and 2B, may include one or more handles 110. The handles 110 may be externally visible from the outside of the safety garment 10 and may be readily accessible to provide a rapid means for a third party to engage the safety garment 10 and wearer, and to lift the wearer out of the water as part of rescue or assistance efforts. Various configurations for the handles 110 may be used. For example, two handles 110 may each attach to different points on respective shoulder straps 102, 104. Alternatively, each handle may attach to a shoulder strap 102, 104 at one end and the central portion on the other end. A third handle may also be included that crosses between the shoulder straps 102, 104, connects to the cross strap 108, or connects to the torso strap 106. Additionally, in some embodiments, only one of the above described handles 110 may be included. To allow the safety garment 10 to be load bearing, the handles may be connected to the shoulder straps 102, 104, cross strap 108, and/or torso strap 106. The handles 110 may be connected, for example, by sewing the handle 110 end sections securely to the shoulder straps 102, 104, cross strap 108, and/or torso strap 106, as illustrated in FIGS. 3-7. Alternative means for securely connecting the handles 110 to the load bearing harness 100 may include heat fusing the ends of the handles 110 to the load bearing harness 100, or through use of a water-resistant adhesive. In further embodiments, the connection of the handle 110 end sections to the shoulder straps 102, 104, cross strap 108, and/or torso strap 106 may be by both sewing and heat fusing, and/or use of an adhesive.

The design of the load bearing harness 100, including the use of high strength textile strap materials is to provide the capability of lifting a wearer, the safety garment 10, any elements attached to the safety garment 10, and the added weight of water held by the wearer, the wearer's clothing, and the safety garment 10. Given that an average male weighs approximately 200 lbs, and adding in a two times safety factor for additional weight, the load bearing harness 100 should be capable of lifting approximately 500 lbs. A reasonable range for strength capability of the load bearing harness 100 is approximately 250 to 1000 lbs, where the upper end of that limit is set in view of a potential 2.5 to 3 times safety factor being applied.

In alternative embodiments to augment load capacity of the safety garment 10, as well as strength and redundancy of the load bearing harness 100, each of the shoulder, torso, and/or cross straps, as well as one or more of the handles may be configured as multiple (e.g., two or more) straps. In such a configuration, the load bearing harness 100 may be configured and designed to be able to lift up to 750 to 1000 lbs.

The safety garment 10 may also incorporate at least one inflatable flotation device 146, 148 as shown in FIGS. 1A, 1B, 2A, 2B, 8A and 8B. The inflatable flotation devices 146, 148 may be formed as part of a garment portion 150, inserted into compartments formed in the garment portion 150, or attached directly to the load bearing harness 100, such as to the torso strap 106.

Figure 8A:
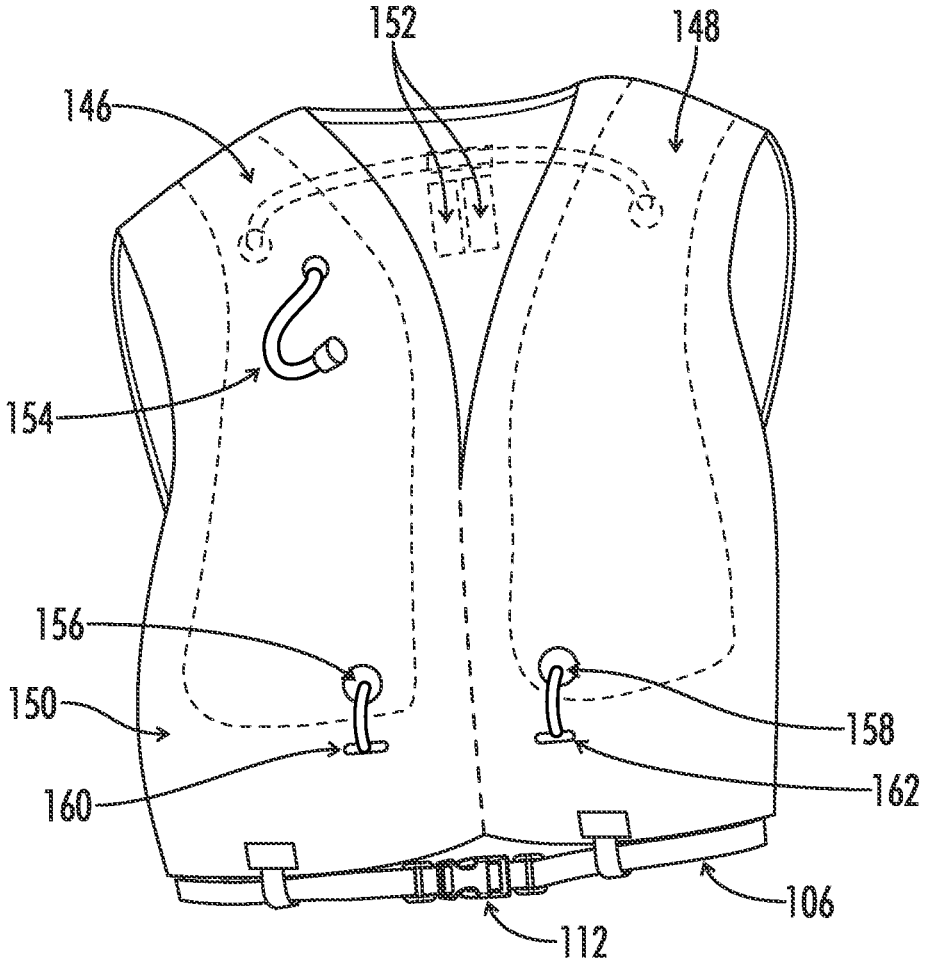
FIG. 8A is a front view of an embodiment of the inflatable safety harness/garment showing inflatable flotation devices and compressed gas canisters.
Figure 8B:
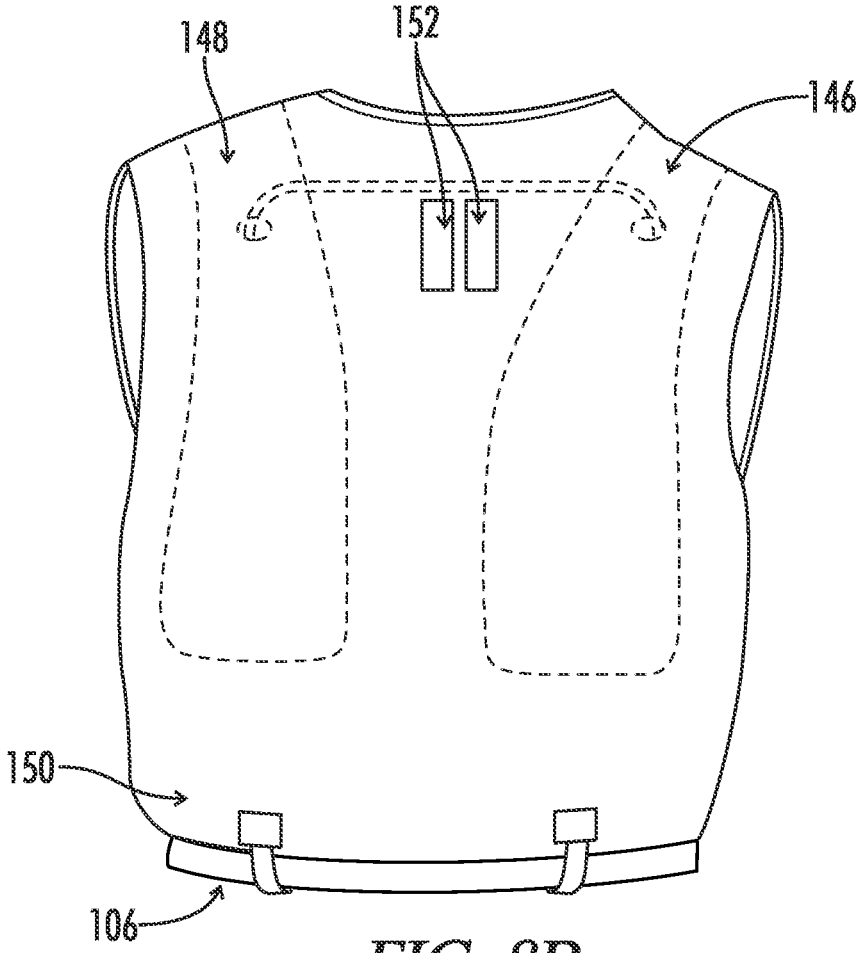
FIG. 8B is a back view of an embodiment of the inflatable safety harness/garment showing inflatable flotation devices and compressed gas canisters.

As shown in FIGS. 8A and 8B, the inflatable flotation devices 146, 148 may be inflated using one or more gas cannisters 152, such as CO2 cartridges, or alternatively, the inflatable flotation devices 146, 148 may be manually inflated through an inlet valve 154. The gas cannisters 152 may be individually connected to one of the inflatable flotation devices 146, 148, or a single gas cannister 152 may connect to more than one of the inflatable flotation devices 146, 148. In one embodiment, when the gas cannisters 152 are triggered, the gas cannisters 152 are configured to inflate, or substantially inflate, the inflatable flotation devices 146, 148. To allow for added utility, each inflatable flotation device 146, 148 may incorporate a relief valve 156, 158, to allow the wearer to deflate either or both inflatable flotation devices 146, 148. Such relief valves 156, 158 are incorporated into each respective inflatable flotation device 146, 148, and may further include a relief pull rings 160, 162 to provide easy control by the wearer.

In different embodiments, the relief valves 156, 158 may be configured to provide for either a fully open or fully closed position. In such a configuration, the relief valve 156, 158 is initially set as fully closed, and then if the wearer opens the relief valve, it is fully open. Alternatively, the relief valve may be variably controlled by the wearer to be open, partially open, or closed, allowing the wearer to partially release a gas within the inflatable flotation device 146, 148, and thereby regulate or control buoyancy levels of the safety garment 10. The gas canisters 152 and inlet valve 154 may also be configured to allow the wearer to control how much gas is allowed to pass into the inflatable flotation devices 146, 148 to control the buoyancy levels of the safety garment 10.

The garment portion 150 may be in the form of a vest or any other form desired by the wearer, such as a long-sleeved shirt or full wetsuit. The garment portion 150 may be made out of neoprene, polyester, nylon, lycra, spandex, any other materials common in water sport apparel, and any combination thereof. For ease of removal and donning, the garment portion 150 may be configured, as shown in FIGS. 1A and 2A, with a zipper 164 element to close the front of the garment portion 150. Alternatively, the garment portion 150 may be configured with other connection means such as snaps, button and loop elements, or magnets positioned within the front edges of the garment portion 150.

The garment portion 150 may also include compartments for holding various tools and devices or for holding additional flotation devices. The compartments may be configured such that any items placed in the compartments are removable, or such that the inserted items are permanently contained in the compartment. The flotation devices may be additional inflatable flotation devices or non-inflatable flotation devices.

Additional elements and features may be incorporated with the safety garment 10 to augment the utility of the safety garment 10. For example, reflectors may be applied to the outside of the garment portion 150, on the front and/or back to improve visibility of the wearer, especially in low-light conditions. Further, the safety garment may be configured to allow various tools and devices to attach to the safety garment 10. In some embodiments, the various tools and devices may be detachably attached to the safety garment 10. For example, moly-type loops may be sewn onto the garment portion 150 to allow for ready attachment of various tools and devices. Alternatively, such devices may be configured to attach to a portion of the harness structure 100, such as the torso strap 106. Examples of the various tools and devices may include lanyard(s), a tool belt, rebreather(s), light emitting device(s), additional flotation devices, and/or a whistle or other acoustic noise generator. The safety garment 10 may also include a GPS device that may be activated by the wearer when necessary. In still further embodiments, the safety garment 10 may have attachment points to allow for attachment of SCUBA and/or SUBA cylinders for ready access and usage by the wearer.

While preferred embodiments of the disclosed water safety harness have been described, in particular with reference to certain figures and exemplary embodiments of the safety harness, such exemplary representations are not to be construed as limiting the scope of the disclosure. By way of example, additional straps, or alternative materials for the straps, inflatable flotation devices, and/or gas canisters, may be used to alter the load capacity or buoyancy capability of the safety harness, with all such alternatives providing similar utility of the safety harness and each such alternatives being within the scope of the claimed invention.

It will be recognized by those skilled in the art that other modifications, substitutions, and/or other applications are possible, and all such modifications, substitutions, and applications are within the true scope and spirit of the present disclosure. It is likewise understood that the above disclosure and attached claims are intended to cover all such modifications, substitutions, and/or applications.

What is claimed is:

1. An inflatable water safety harness to provide buoyancy to a wearer, comprising:

a garment portion including a full length zipper configured to extend from a neck region to a bottom of the garment, to close the garment portion, and to allow a wearer to more easily put on and remove the inflatable water safety harness;

a harness structure for securing the inflatable water safety harness to the wearer, the harness structure including:

at least two shoulder portions;

at least one torso portion for encircling the torso of the wearer, each torso portion connected to the shoulder portions;

at least one central portion, each central portion connecting to the at least two shoulder portions;

at least one handle connected to the harness structure; and at least one inflatable flotation device connected to the harness structure;

wherein the inflatable water safety harness is capable of lifting the wearer.

2. The inflatable water safety harness of claim 1, further comprising:

a garment portion including the harness structure and the at least one inflatable flotation device.

3. The inflatable water safety harness of claim 2, wherein the garment portion further includes at least one compartment configured to receive a flotation device.

4. The inflatable water safety harness of claim 1, further comprising:

at least one compressed gas canister; and wherein each of the at least one inflatable flotation devices is connected to at least one of the compressed gas canisters;

wherein triggering the compressed gas canister is configured to substantially inflate each of the connected inflatable flotation devices.

5. The inflatable water safety harness of claim 4, wherein the at least one compressed gas canister contains CO2.

6. The inflatable water safety harness of claim 1, wherein the at least one inflatable flotation device further comprises:

an inlet valve configured to allow the wearer to manually inflate the inflatable flotation device.

7. The inflatable water safety harness of claim 1, wherein the at least one inflatable flotation device further comprises:

a relief valve configured to allow the wearer to deflate the inflatable flotation device.

8. The inflatable water safety harness of claim 1, wherein the harness structure further comprises:

a crotch portion connected to the torso portion, the crotch portion including two leg loops for receiving the wearer's legs.

9. The inflatable water safety harness of claim 1, wherein the harness structure is capable of lifting a weight greater than approximately 300 pounds.

10. The inflatable water safety harness of claim 1, wherein the at least one central portion further comprises:

a back cross strap configured to connect the at least two shoulder portions across the wearer's back; and a front cross strap configured to connect the at least two shoulder portions across the wearer's chest.

11. The inflatable water safety harness of claim 1, wherein the central portion forms a loop connecting to the at least two shoulder portions, the central portion including a connecting portion connecting to the torso portion.

12. The inflatable water safety harness of claim 1, further comprising:

at least one attachable device configured to connect to the torso portion.

13. The inflatable water safety harness of claim 12, wherein the at least one attachable device is one of a radio, a GPS device, a set of first responder tools, a light emitting device, or a flotation device.

14. The inflatable water safety harness of claim 12, wherein the at least one attachable device is detachably connectable to the torso portion.

15. The inflatable water safety harness of claim 1, wherein the inflatable flotation device is configured to partially inflate to provide a chosen buoyancy support to the wearer.

16. The inflatable water safety harness of claim 1, wherein the at least one handle includes a first end and a second end, the first end and the second end being connected to one of the shoulder portions.

17. The inflatable water safety harness of claim 1, wherein the at least one handle includes a first end and a second end, the first end being connected to one of the shoulder portions and the second end being connected to one of the central portions.

18. The inflatable water safety harness of claim 1, wherein the at least one handle includes two handles.

19. An inflatable water safety harness to provide buoyancy to a wearer, comprising:

a garment portion including a full length zipper configured to allow the wearer to more easily put on and remove the inflatable water safety harness;

a harness structure connected to the garment portion including:

two shoulder portions, each shoulder portion including two end sections;

a torso portion for encircling the waist of a wearer, wherein the two end sections of each shoulder portion are slidably connected to a front and back section of the torso portion, and the torso portion including a quick side release buckle;

a central portion including two end sections, wherein the central portion end sections are each connected to the two shoulder portions to form an H-shaped harness structure;

a first handle connected to the first shoulder portion;

a second handle connected to the second shoulder portion;

a third handle connected to the central portion; and at least two inflatable flotation devices connected to the garment portion;

wherein the harness structure is configured to lift a weight greater than approximately 300 pounds.

* * * * *